US009657988B1

(12) United States Patent
Horinek

(10) Patent No.: US 9,657,988 B1
(45) Date of Patent: May 23, 2017

(54) DRYING SYSTEM FOR PROTECTIVE EYEWEAR

(71) Applicant: Steven C. Horinek, Fort Myers, FL (US)

(72) Inventor: Steven C. Horinek, Fort Myers, FL (US)

( * ) Notice: Subject to any disclaimer, the term of this patent is extended or adjusted under 35 U.S.C. 154(b) by 733 days.

(21) Appl. No.: 14/136,550

(22) Filed: Dec. 20, 2013

Related U.S. Application Data

(60) Provisional application No. 61/740,694, filed on Dec. 21, 2012.

(51) Int. Cl.
*F26B 21/00* (2006.01)

(52) U.S. Cl.
CPC ..... *F26B 21/003* (2013.01); *F26B 21/004* (2013.01)

(58) Field of Classification Search
CPC ..... F26B 21/003; F26B 21/004
See application file for complete search history.

(56) References Cited

U.S. PATENT DOCUMENTS 3,440,733 A * 4/1969 Reuter ..... F26B 3/08 34/362
3,545,493 A * 12/1970 Freeman ..... F16L 9/127 138/115
5,794,635 A * 8/1998 Maines ..... G02C 13/006 134/155
6,119,471 A * 9/2000 Tanaka ..... F25D 11/003 340/585

* cited by examiner

*Primary Examiner* — Jiping Lu
(74) *Attorney, Agent, or Firm* — William E. Noonan

(57) ABSTRACT

A system is provided for drying precipitation from protective eyewear of the type worn by a motorcyclist or other person operating a vehicle when the operator is exposed to the elements. A compressor delivers compressed air to an air tank which is, in turn, connected through a conduit to the eyewear. An activation switch is operated to open a solenoid valve, which allows air to be transmitted through the conduit from the air tank to the glasses. One or more discharge openings of the conduit are directed at the lens(es) of the eyewear such that when the activation switch is closed, compressed air is delivered through the discharge opening(s) and directed toward the lens(es) to dry the eyewear.

14 Claims, 5 Drawing Sheets

DRYING SYSTEM FOR PROTECTIVE EYEWEAR

RELATED APPLICATION

This application claims the benefit of U.S. Provisional Application Ser. No. 61/740,694 filed Dec. 21, 2012.

FIELD OF THE INVENTION

This invention relates to a system that uses compressed air to dry precipitation from protective eyewear of the type worn by a motorcyclist or other vehicle operator who is exposed to the elements.

BACKGROUND OF THE INVENTION

A motorcyclist is typically required to wear protective eyewear in the form of glasses or goggles while riding a motorcycle. During the course of a trip, the motorcyclist may encounter various types of precipitation such as rain, fog, sleet, snow, etc. If the rider keeps driving, such precipitation is apt to collect on the lenses of his or her protective eyewear. This is likely to impair the motorcyclist's vision and create a serious safety hazard. As a result, the motorcyclist may elect to stop the vehicle completely in order to clean and dry the wet eyewear. This can be inconvenient and annoying and may cause travel delays, particularly if the precipitation continues and repeated stops are required. Alternatively, the rider may attempt to clean their eyewear while continuing to drive. This constitutes an obvious driving danger.

SUMMARY OF THE INVENTION

It is therefore an object of the present invention to provide a conveniently compact and portable system for drying precipitation from protective eyewear, which is especially effective for use by motorcyclists.

It is a further object of this invention to provide an eyewear drying system that quickly and effectively dries glasses, goggles and other types of protective eyewear while the wearer continues to operate a vehicle and without requiring the wearer to inconveniently and/or repeatedly stop the vehicle in order to dry the eyewear.

It is a further object of this invention to provide an eyewear drying system that is effective for use by persons operating various types of vehicles outdoors including, but not limited to, motorcycles, marine vessels, personal watercraft, gliders, bicycles, and ATVs.

It is a further object of this invention to provide a drying system for protective eyewear worn by a person operating a vehicle, which quickly, conveniently and effectively dries precipitation from the eyewear without interrupting the wearer's operation of the vehicle and without dangerously distracting the wearer operating the vehicle.

It is a further object of this invention to provide an eyewear drying system that effectively dries precipitation from the eyewear of a motorcyclist of other vehicle operator without unduly disrupting the wearer's attention from safe operation of the vehicle.

It is a further object of this invention to provide an eyewear drying system that is compact and fits conveniently in the saddle bag of a motorcycle or other vehicle or elsewhere on a vehicle without disturbing operation of the vehicle.

This invention results from a realization that compressed air may be used to quickly, conveniently and effectively dry the lenses of glasses, goggles or other types of protective eyewear worn by a motorcyclist or other operator of a vehicle while the vehicle is being driven through precipitation. This invention results from the further realization that such compressed air may be effectively delivered across the lens or lenses of the eyewear while the vehicle is being driven and without distracting the wearer/driver of otherwise dangerously interfering with operation of the vehicle.

This invention features a system for drying precipitation from the lens or lenses of protective eyewear of the type worn by a motorcyclist or other vehicle operator while the vehicle is being driven and without distracting the wearer/driver or otherwise dangerously interfering with operation of the vehicle. The system includes an air tank and a compressor for supplying compressed air to the tank. A conduit is provided for communicably interconnecting the air tank to the eyewear. The conduit includes one or more discharge openings pointed at the lens or lenses of the eyewear. A solenoid valve is interengaged with the conduit between the air tank and the eyewear. A solenoid activation switch is selectively alternated between a first state for opening the solenoid valve to deliver compressed air through the conduit from the tank to the eyewear and a second state for closing the valve and blocking the flow of compressed air through the conduit from the air tank to the eyewear. When the valve is open, compressed air is delivered through each discharge opening of the conduit and directed across the lens or lenses of the eyewear to dry precipitation therefrom.

In a preferred embodiment, electric power is provided to the compressor by the power supply of the vehicle. An on/off switch may be interconnected between the power supply of the vehicle and both the compressor and the solenoid activation switch. Opening the on/off switch deactivates the drying system. Closing the on/off switch supplies power to operate the compressor. A charging light may be provided to indicate that the compressor is operating. Closing the on/off switch also provides power to the solenoid activation switch such that closing the activation switch opens the solenoid valve to deliver compressed air to the lens or lenses of the eyewear.

A pneumatic compression switch may be connected communicably to the air tank and include a contact for selectively interconnecting the on/off switch and the compressor. When the pressure of the compressed air in the air tank is below a predetermined value, the compression switch contact is held closed so that when the on/off switch is also closed, power is delivered to operate the compressor. Alternatively, when the pressure in the air tank exceeds a predetermined amount, the contact of the compression switch opens and power to the compressor is discontinued. At that point, no further compressed air is provided to the air tank.

The conduit may include a first section that is joined communicably to an output of the solenoid valve and a second section that is connected to the eyewear. The conduit may include one or more additional sections interconnecting the air tank and an inlet side of the solenoid. The first and second sections are preferably themselves interconnected by a quick connect apparatus. The second conduit section may include a pair of conduit branches that are secured to respective sides of the eyewear. Each branch of the conduit includes a respective discharge opening that is pointed or otherwise directed at a corresponding lens of the eyewear.

Typically, the first conduit section includes a relatively large diameter main tube and the second conduit section includes a pair of relatively small diameter branch tubes that are communicably interconnectable to the main tube. Each of the branch tubes is embedded in or otherwise mounted to extend along a respective earpiece and across the frame of the eyewear. The branch tubes may intersect proximate a bridge of the eyewear such that the discharge opening formed on each branch tube is directed at a respective lens on the opposite or same side of the eyewear.

DETAILED DESCRIPTION OF PREFERRED EMBODIMENTS

Other objects, features and advantages will occur from the following description of a preferred embodiment and the accompanying drawings, in which:

FIG. 1 is a schematic view of the electrical and pneumatic components of the eyewear drying system of this invention; and FIG. 2 is a simplified view of the protective eyewear with a pair of air transmitting branch tubes attached to and extending along corresponding ear pieces of the eyewear; the discharge end of each tube is pointed toward a corresponding lens of the eyewear in order to direct compressed air as required across the corresponding lenses and dry precipitation therefrom;

Figure 1:
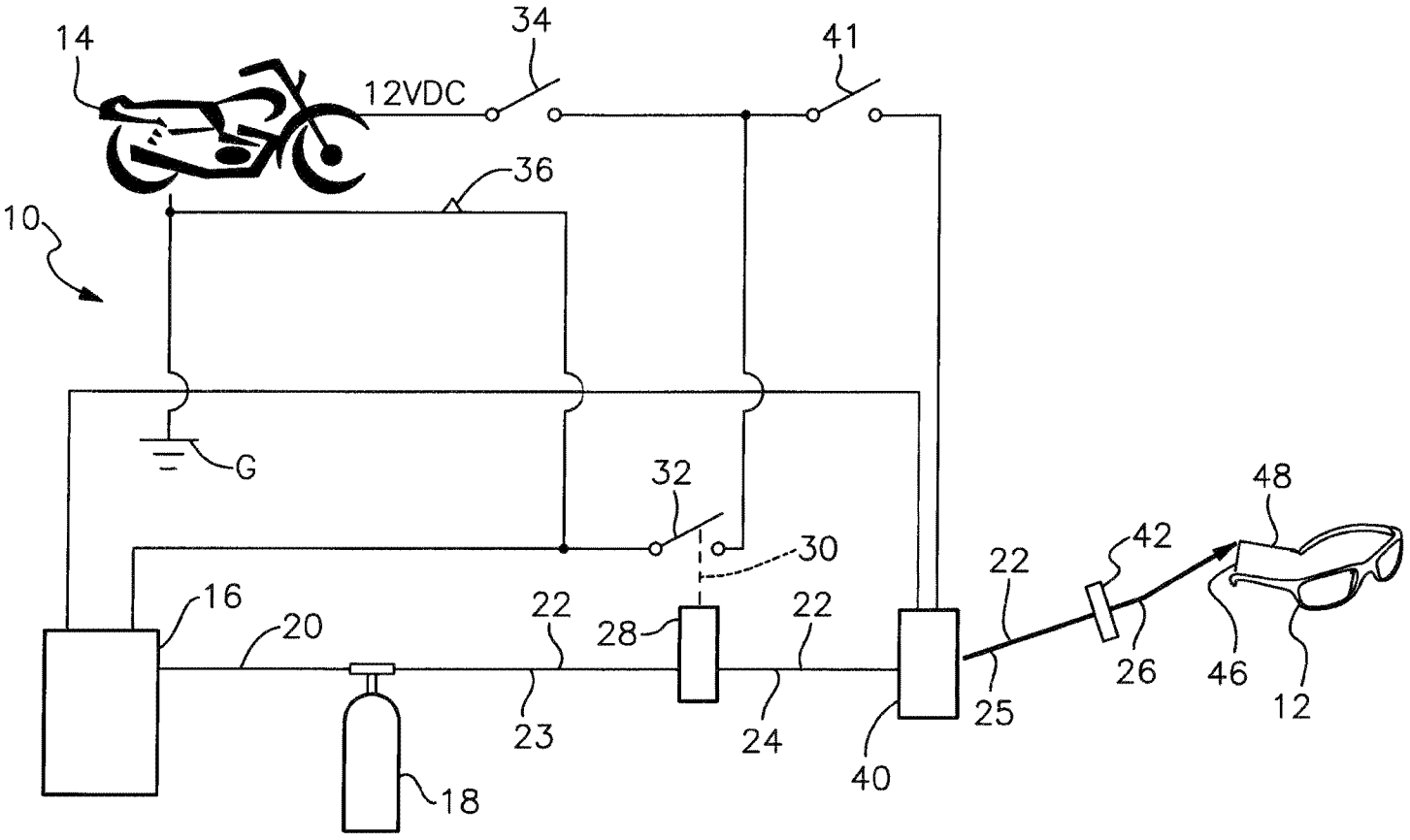

There is shown in FIG. 1 a system 10 for drying precipitation from the lenses of protective eyewear 12 worn by a motorcyclist operating a motorcycle 14. Although the present invention is described herein in connection with the protective eyewear used by a motorcyclist, it should be understood that the invention may also be employed just as effectively for drying protective eyewear used in various other applications where a vehicle operator is exposed to the elements including precipitation. For example, the system may be used effectively by bicyclists, boaters, personal watercraft and ATV operators, glider and ultralight pilots and various other persons engaged in outdoor vehicle operation. The particular vehicle or application for which the system is used is not a limitation of this invention. It is simply required that the system be used to dry the glasses, goggles, visors or other types of protective eyewear worn by a person operating or riding a land, water or airborne vehicle (e.g. glider, jet ski, personal watercraft, ATV etc). The eyewear may feature a single lens such as used in goggles or a visor, or a pair of lenses, as employed in eyeglasses.

As shown in FIG. 1, system 10 includes a small DC operated compressor 16 that is powered by the standard 12-volt battery of motorcycle 14. In other versions a separate dedicated battery may be provided for operating the compressor. The compressor is capable of producing 7.28 liters per minute of compressed air although this amount may be varied within the scope of this invention. Assorted models, size and capacities of compressor may be employed. Compressor 16 is communicably connected to the inlet of a one quarter gallon air tank 18 through a hose 20. The air tank has a capacity of up to 100 PSI, although the size and capacity of the tank likewise may be varied within the scope of this invention.

A conduit 22 comprising successive sections or segments 23, 24, 25 and 26 of vinyl tubing communicably interconnect air tank 18 and eyewear 12 in a manner described more fully below. Each section of tubing has an outer diameter of approximately ¼" and an inner diameter of about 0.0170". These dimensions may be varied within the scope of the invention.

Tubing section 23 communicably interconnects air tank 18 and a pneumatic compression switch 28. As is described more fully below, switch 28 includes an armature 30 that operates a contact 32 in the circuit connecting compressor 16 to the 12-volt battery of motorcycle 14. This circuit also includes on/off switch 34, which is interconnected between the battery and contact 32. A charging light 36, the function of which is described more fully below, is interconnected between contact 32 and ground G.

Tubing section 24 communicably interconnects compression switch 28 and a solenoid valve 40. A solenoid activation switch 41 is electrically interconnected between the motorcycle battery and solenoid 40. This switch is selectively opened and closed to operate the solenoid when the drying system is activated in a manner described more fully below.

Figure 2:
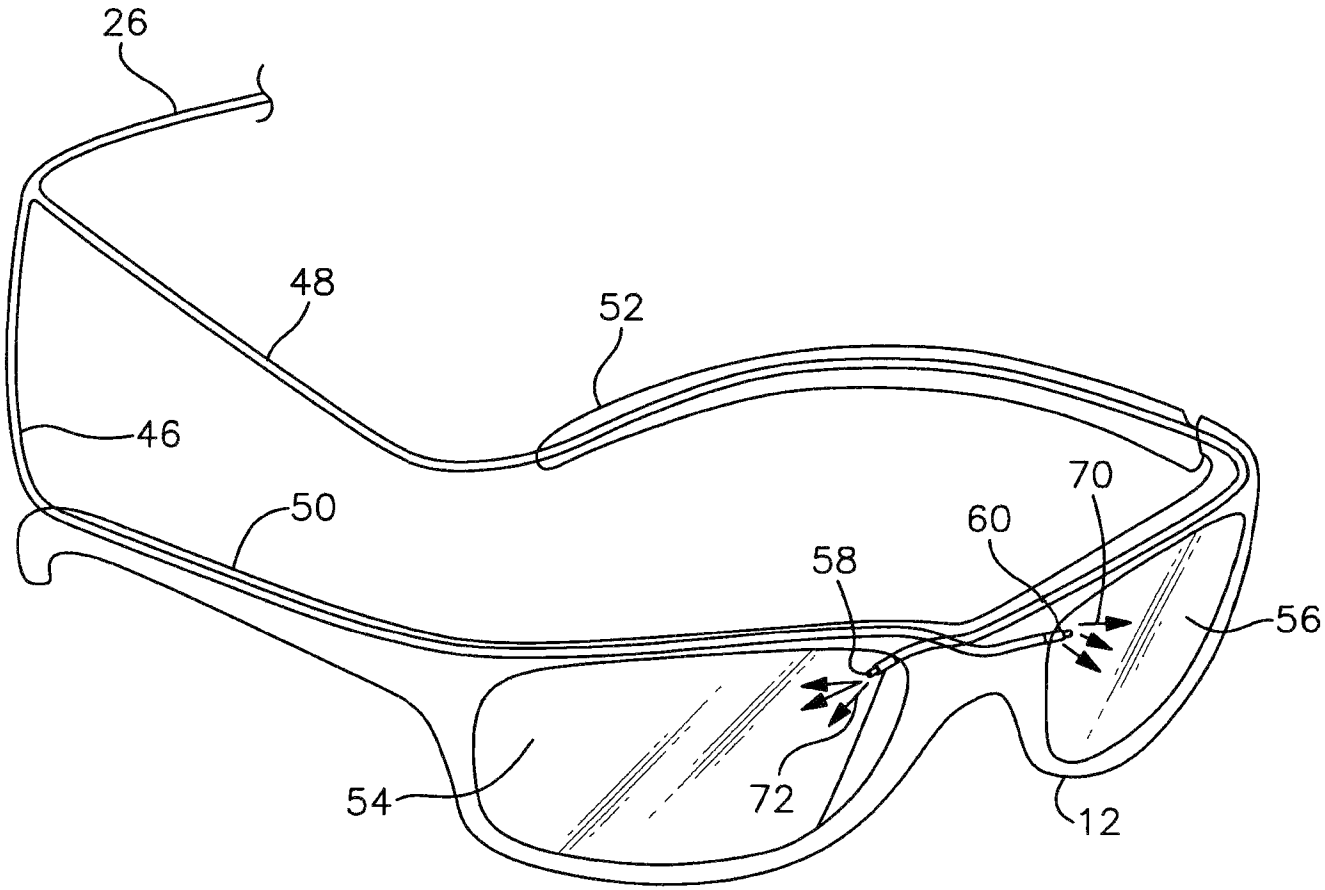

Additional tubing sections 25 and 26 of tubing 20 interconnect the output of solenoid 40 with eyewear 12. Tubing sections 25 and 26 are themselves releasably interconnected by a conventional quick-connect bulkhead connector 42, which is located on or proximate the bulkhead of the motorcycle. Tubing section 26 is itself approximately 4' long so that it may extend comfortably from the bulkhead to the glasses of the wearer. As further shown in FIG. 2, the distal end of tubing section 26 is communicably joined to a pair of small diameter conduit tubs 46 and 48. In the version described herein, the tubes feature an outer diameter of 0.09" and an inner diameter of 0.05". Alternative dimensions may be employed within the scope of the invention. The communicable interconnection between small tubes 46, 48 and larger diameter main tubing section 26 can be effected by various types of conventional constructions employed in the medical and industrial fields. As best shown in FIG. 2, small diameter tubes may be embedded or otherwise mounted along respective earpieces 50 and 52 of eyewear 12. More particularly, tubing segment 46 extends along earpiece 50 and along the frame of the eyewear above lens 54. Tubing segment 48 similarly extends along earpiece 52 and along the upper edge of the frame of the eyewear above lens 56. The terminal end of tubing segment 52 includes a discharge port 58 and the terminal end of tubing section 50 similarly includes a discharge port 60. Port 58 is pointed at or tangentially to lens 54. Port 60 is similarly directed at or arranged, assembled and tangentially to lens 56. In alternative versions the tubing may be reconfigured so that discharge ports 58 and 60 are directed at lenses 56 and 54 respectively.

Although system 10 is depicted primarily in a schematic, conceptual manner in FIGS. 1 and 2, it should be understood that the system is compactly arranged, assembled and mounted on the motorcycle 14. In particular, compressor 16, tank 18 and switches 28 and 40 are typically constructed in an integral unit that is stored compactly and conveniently in the saddle bag of the motorcycle. In some cases, the switch 28 and solenoid 40 may be mounted by appropriate brackets on the body, frame or chassis of the motorcycle. The individual electrical components may be wired in a known or conventional manner, as represented in FIG. 1, and such wiring may be installed in a convenient manner such as attached to the handlebar or body of the motorcycle and in the saddlebag as required. Typically, on/off switch 34 and solenoid activation switch 41 are conveniently accessible to the motorcyclists and are preferably located on the handlebar or in an easily accessible location on the chassis of the vehicle. The compressor and trunk are almost always stored as a unit in the saddlebag or other convenient location of the pertinent vehicle.

In operation, system 10 is installed in and carried on the motorcycle so that it is quickly and conveniently accessible during a rainstorm, snowfall, sleet, heavy fog, mist, etc. As precipitation approaches or begins to fall and collect on the lenses 54 and 56 of eyewear 12, on/off switch 34 is closed by the driver. If the air in tank 18 is below a predetermined value (e.g. 55 psi) compression switch 28 holds contact 32 closed. As a result, power is provided from the battery to compressor 16. The compressor operates to produce compressed air, which is delivered to tank 18 through hose 20. While the compressor is operating, charging light 36 is lit to indicate that compressed air is being produced. When the pressure in tank 18 exceeds the predetermined level, (e.g. 55 psi) switch 28 opens contact 32 to turn off the compressor. It should be understood that this operation may also be performed before precipitation commences so that delays are avoided and the system 10 is ready to perform immediate drying, as needed.

In order to dry the lenses of eyewear 12, the wearer presses and closes solenoid activation switch 41. This delivers power through the previously closed switch 34 to solenoid valve 40. The valve opens and compressed air is delivered from tank 18 through conduit 22 to eyewear 12. More particularly, air is transmitted through tubing sections 23, 24, 25 and 26 to the diverging branch tubes 46 and 48. Before the switch 41 is pressed, the wearer must make sure that tubing section 26 is communicably joined to tubing section 25 by quick connect bulkhead connector 42. This connection may be made either in advance of the precipitation or when the precipitation commences.

The compressed air is transmitted through embedded tubes 46 and 48 and delivered from discharge openings 58 and 60 across respective lenses 56 and 54 as indicated by arrows 70 and 72 respectively. The compressed air is blown forcefully across lenses 54 and 56 to dry or remove precipitation that has collected on the lenses. Drying is performed almost instantaneously and very effectively. The motorcyclist's vision is improved considerably and driving safety is thereby improved. Such compressed air drying of the lenses may then be repeated at selected intervals and/or as needed.

System 10 allows the lenses of the eyewear to be dried quickly and conveniently without hindering operation of the motorcycle or other vehicle. The user does not have to stop, possibly repeatedly, to clean and dry the glasses. By the same token, the wearer does not have to search for, access and use a cloth or towel to wipe the glasses. As a result, the driver is not unduly distracted and vehicle is therefore operated in a much safer manner.

System 10 may be operated as often as required to keep the lenses dry. If the compressed air is fully depleted from tank 18, it can be simply and quickly restored by resuming operation of compressor 16. Indeed, the compressor automatically restarts when on/off switch 34 remains closed and the pressure in the tank falls below the predetermined level (thereby causing contact 32 to be closed by compression switch 28).

It should be understood that the details described herein may be varied within the scope of this invention. For example, the tubing for transmitting compressed air may be attached by appropriate brackets and clips to the eyewear. The tubing may also be embedded integrally within the frame of the eyewear. The hose/tubing may comprise various materials suited for transmitting compressed air. The wiring and components of the system may be reconfigured in a manner that will be understood to persons skilled in the art to accomplish the operation described herein.

Figure 3:
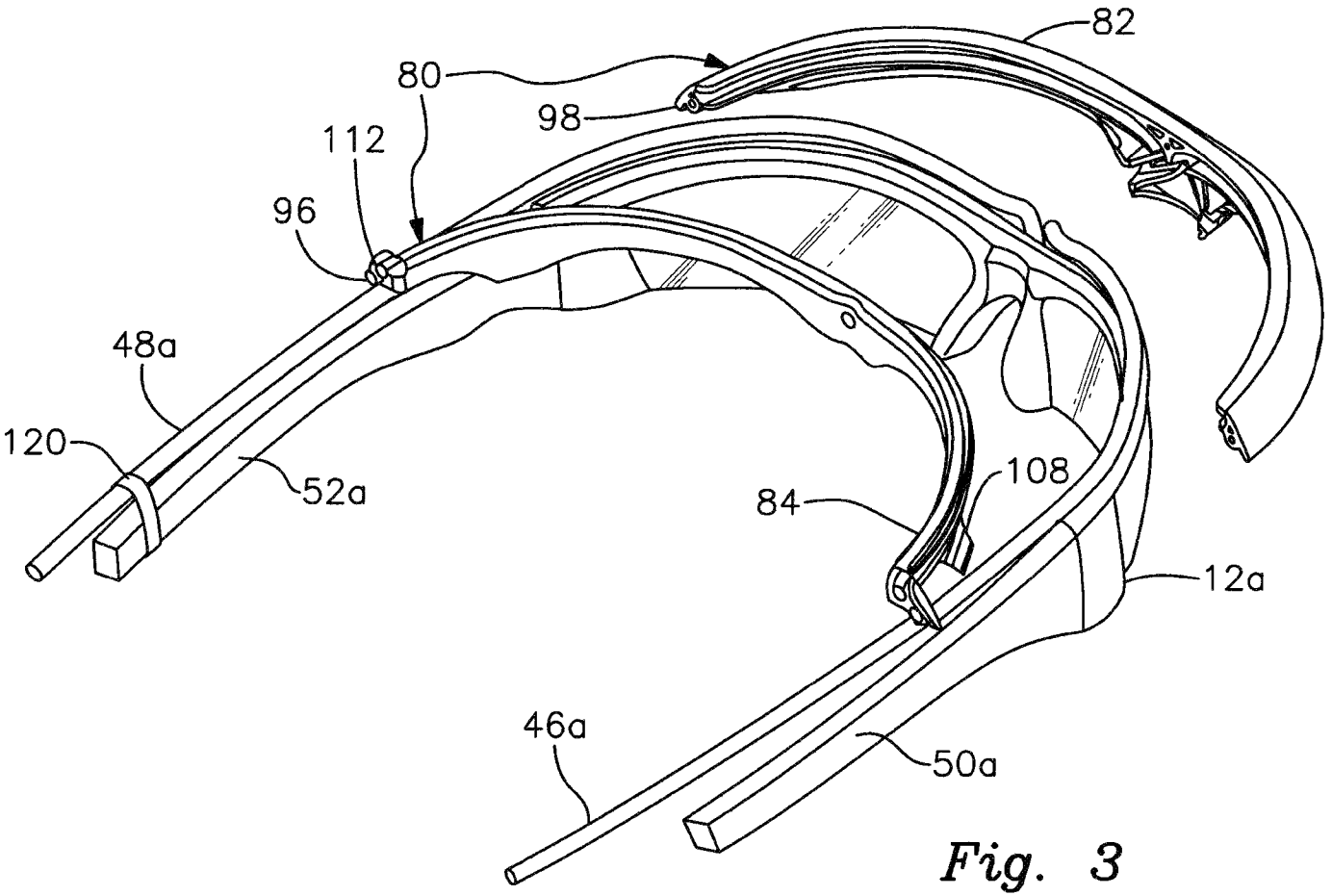
FIG. 3 is an exploded top perspective view of the protective eyewear equipped with a two piece conduit mounting bracket for mounting the air transmitting branch tubes to the eyewear.
Figure 4:
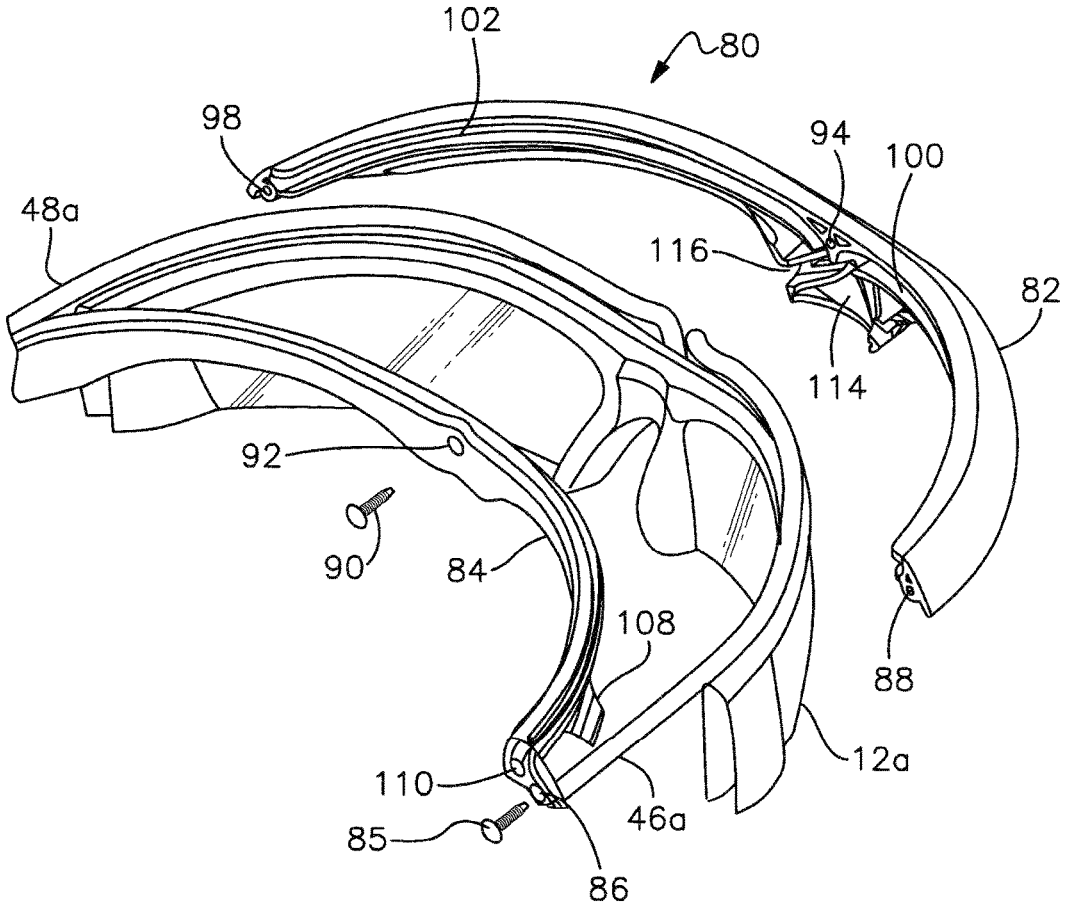
FIG. 4 is an enlarged, fragmentary view of the eyewear shown in FIG. 3 with the earpieces omitted for clarity.
Figure 5:
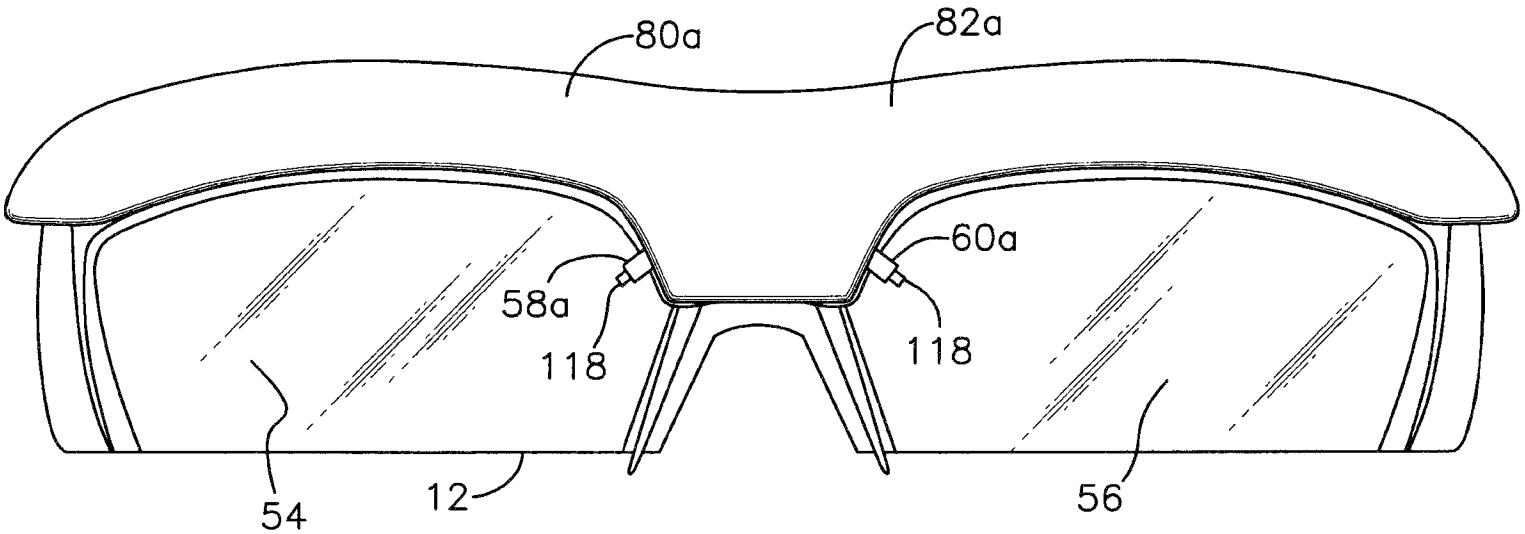
FIG. 5 is an elevational front view of the protective eyewear with the conduit mounting bracket secured thereto.

FIGS. 3-5 depict an alternative version of the invention wherein air transmitting branch tubes 46*a* and 48*a* are supported on eyewear 12*a* by a mounting bracket assembly 80. The mounting bracket assembly (which is typically composed of a plastic or synthetic material) comprises forward and rearward bracket pieces 82 and 84, respectively, that are joined together by fastening screws interengaged with aligned, threaded holes in pieces 82 and 84. In particular, a first one of the fastening screws 85 is engaged with aligned holes 86 and 88 in rear bracket 84 and front bracket piece 82 respectively. A second fastening screw 90 is similarly engaged with a hole 92 in bracket piece 84 and an aligned hole 94 in front bracket piece 82. Finally, a third fastening screw, not shown, is similarly interengaged with a left hand hole 96, FIG. 3 in bracket piece 84 and a complementary aligned hole 98 in front bracket piece 82.

The front bracket piece includes a right hand arcuate channel 100 and a left hand arcuate channel 102 for accommodating branch tubes 46*a* and 48*a*, respectively. As best shown in FIG. 3, these branch tubes extend along the upper edges of ear pieces 50*a* and 52*a*, respectively. When the front and rear bracket pieces 82 and 84 are joined together by the fastening screws, the mounting bracket 80 is secured to eyewear 12*a* by engaging tabs 108 that depend integrally from rear bracket piece 84 to the respective ear pieces 50*a* and 48*a*. In FIGS. 3 and 4 only the right hand tab 108 is shown. It should be understood that a similar tab is carried by the rear bracket piece 84 proximate the opposite end of the rear bracket piece for engaging ear piece 48*a*. With the front and rear bracket pieces 82*a* and 84*a* fastened together and attached to eyewear 12*a*, the mounting bracket 80*a* is secured along the top of eyewear 12 as depicted in FIG. 5.

Branch tubes 46*a* and 48*a* extend respectively along the upper edges of ear pieces 50*a* and 52*a*. Tube 46*a* enters channel 100 of mounting bracket 80*a* through right hand opening 110 in rear bracket piece 84. See FIG. 4. Tube 48*a* enters channel 102 of bracket 80*a* through a similar opening 112 in rear bracket piece 84. See FIG. 3. Each branch tube extends through a respective arcuate channel 100, 102 in the mounting bracket. Each tube 46*a*, 48*a* bends downwardly, effectively makes a "U-turn" and extends through a respective exit port 114, 116. Tubes 46*a* and 48*a* include discharge openings 58*a* and 60*a* for directing air from the compressor across respective lenses 54 and 56 of eyewear 12. Each discharge opening may carry an adapter tube or nozzle 118, FIG. 5, for directing air flow across the lenses and/or increasing the velocity of that air flow.

The branch tubes 46*a* and 48*a* may be covered rearwardiy of the mounting bracket by respective coverings comprising, for example, a shrinkable fabric tube or alternative material. Each branch tube may be secured to a respective ear piece by a small band 120, FIG. 3, that is wrapped around the earpiece and the branch tube extending along that ear piece.

The version of this invention employing the air transmitting conduit mounting bracket operates in a manner analogous to that disclosed in the previously described embodiment. The construction of the mounting bracket, the manner in which it accommodates the branch tubes and the way in which is it secured to the eyewear may be varied in accordance with this invention and in a manner that will be understood to persons skilled in the art.

In an embodiment such as a bicycle wherein the vehicle does not include its own 12-volt battery or other power source, the compressor and tank may be replaced by a small high pressure tank. A preferred tank of this type is approximately 6 cubic feet in size, e.g. 3.5" diameter by 11" length, and has a capacity of 3,000 PSI, which is comparable to a small portable dive tank. This tank may also include a regulator to reduce the pressure to 55 lbs. Power may be provided by small dry cell flash batteries to operate the solenoid switch. Although such a configuration and alternative compressor/tank constructions may be employed for this invention, a small pressure is typically preferred for safety reasons.

It should again be understood that the system may be used in conjunction with a variety of outdoor vehicles including, but not limited to motorcycles, bicycles, personal watercraft, all terrain vehicles, gliders, ultralight aircraft, etc. The system is effective for use in virtually any application where the operator's attention should remain as fixed as possible on operating the vehicle and wherein wiping and drying the lenses of the eyewear while continuing to operate the vehicle would otherwise be dangerous and unadvisable.

From the foregoing it may be seen that the apparatus of this invention provides for a system for using compressed air to dry protective eyewear of the type worn by a motorcyclist when the wearer is riding in the rain. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An eyewear precipitation drying system comprising:

eyewear having a transparent lens;

a source of compressed gas, said source of compressed gas including an electrically operated compressor for providing the gas with a selected pressure and a tank for holding the compressed gas;

a conduit communicably connecting said source of compressed gas to said eyewear, said conduit including a discharge opening directed toward said lens;

a solenoid valve interconnected to said conduit between said source of compressed gas and said eyewear;

a solenoid activation switch operably connected to said valve and being selectively alternated between a first state for opening said valve to deliver compressed air gas through said conduit to said eyewear, which gas is discharged through said discharge opening and directed across said lens to dry precipitation therefrom and a second state for closing said valve and blocking the flow of compressed gas through said conduit from said tank to said eyewear; and a vehicle having an electric power supply and an ON/OFF switch that is selectively closed to electrically activate said vehicle and opened to deactivate said vehicle, said compressor and said solenoid activation switch being electrically connected to said ON/OFF switch such that opening said ON/OFF switch deactivates said compressor and said solenoid activation switch to disable the drying system and closing said ON/OFF switch supplies electric power to said compressor and to said solenoid activation switch, whereby in said first state, said solenoid activation switch opens said solenoid valve and, in said second state, said solenoid activation switch closes said solenoid valve.

2. The system of claim 1 further including a pneumatic compression switch connected communicably to said tank and including a contact for selectively interconnecting said on/off switch and said compressor, said compression switch being held closed when the pressure of the gas in said tank is below a predetermined level such that closing said on/off switch delivers electric power to operate said compressor, said compression switch being opened when the pressure of the gas in said tank exceeds said predetermined level to deactivate said compressor.

3. The system of claim 2 further including a charging light electrically connected to said compression switch for being activated to indicate that said compressor is operating.

4. The system of claim 1 in which said conduit includes a first section communicably joined to an output of said valve and a second section connected to said eyewear.

5. The system of claim 4 in which said first and second sections are releasably joined by a quick connect device.

6. The system of claim 4 in which said second conduit section includes a pair of conduit branches secured to respective sides of said eyewear.

7. The system of claim 6 in which each said conduit branch includes a respective discharge opening directed at a corresponding said lens of said eyewear.

8. An eyewear precipitation drying system comprising:

eyewear having a transparent lens;

a source of compressed gas;

a conduit communicably connecting said source of compressed gas to said eyewear;

a valve interconnected to said conduit between said source of compressed gas and said eyewear, said conduit including a first section communicably joined to an output of said valve and a second section connected to said eyewear, said second conduit section including a pair of conduit branches secured to respective sides of said eyewear, each said conduit branch being embedded and extending through a respective ear piece of said eyewear and wherein each said conduit branch terminates in a discharge opening directed at a corresponding said lens of said eyewear; and an activation switch operably connected to said valve and being selectively alternated between a first state for opening said valve to deliver compressed gas through said conduit to said eyewear, which gas is discharged through each said discharge opening and directed across said corresponding lens to dry precipitation therefrom and a second state for closing said valve and blocking the flow of compressed gas through said conduit from said tank to said eyewear.

9. An eyewear precipitation drying system comprising:

eyewear having a transparent lens;

a source of compressed gas;

a conduit communicably connecting said source of compressed gas to said eyewear;

a valve interconnected to said conduit between said source of compressed gas and said eyewear, said conduit including a first section communicably joined to an output of said valve and a second section connected to said eyewear, said second conduit section including a pair of conduit branches secured to respective sides of said eyewear, said eyewear carrying a mounting bracket assembly for supporting said conduit branches on said eyewear, and wherein each said conduit branch terminates in a discharge opening directed at a corresponding said lens of said eyewear; and an activation switch operably connected to said valve and being selectively alternated between a first state for opening said valve to deliver compressed gas through said conduit to said eyewear, which gas is discharged through each said discharge opening and directed across said corresponding lens to dry precipitation therefrom and a second state for closing said valve and blocking the flow of compressed gas through said conduit from said tank to said eyewear.

10. The system of claim 9 in which said mounting bracket includes a pair of arcuate channels, each for accommodating a respective one of said branch conduits.

11. The system of claim 9 in which said mounting bracket carries a pair of tabs for interengaging respective earpieces of said eyewear.

12. The system of claim 11 in which said mounting bracket includes a pair of generally conforming forward and rearward concave pieces that are releasably and nestably interconnected to one another and supported on said eyewear.

13. The system of claim 12 in which each said channel is disposed between said concave pieces and includes a reverse direction forward end that orients said discharge end of a respective said conduit branch such that said discharge end is directed at a corresponding lens.

14. The system of claim 12 in which said rearward concave pieces carries a fastener projection at each of two opposing ends, each projection having a first hold for receiving a threaded connector that is engageable with a corresponding hole in said forward piece and a second hole for accommodating a respective conduit branch and communicating with a respective channel formed in said eyewear.

* * * * *